United States Patent [19]

Erckel et al.

[11] Patent Number: 4,556,432

[45] Date of Patent: Dec. 3, 1985

[54] PROCESS FOR HYDROLYZING CELLULOSE-CONTAINING MATERIAL WITH GASEOUS HYDROGEN FLUORIDE

[75] Inventors: Rüdiger Erckel, Eppstein; Raimund Franz, Kelkheim; Rolf Woernle, Bad Soden am Taunus; Theodor Riehm, Heidelberg, all of Fed. Rep. of Germany

[73] Assignee: Hoechst Aktiengesellschaft, Fed. Rep. of Germany

[21] Appl. No.: 710,533

[22] Filed: Mar. 12, 1985

Related U.S. Application Data

[63] Continuation of Ser. No. 434,582, Oct. 15, 1982, abandoned.

[30] Foreign Application Priority Data

Oct. 24, 1981 [DE] Fed. Rep. of Germany ..... 3142215

[51] Int. Cl.[4] ..... C13K 1/02

[52] U.S. Cl. ..... 127/37; 162/14; 162/63

[58] Field of Search ..... 162/19, 47, 66, 63, 162/67, 88, 89, 34, 35, 42, 248, 249, 241, 14, 15, 16; 127/2, 37

[56] References Cited

U.S. PATENT DOCUMENTS

| | | | |
|---|---|---|---|
| 3,481,827 | 12/1969 | Brooks | 162/63 |
| 3,619,350 | 7/1969 | Marchfelder | 162/67 |
| 3,919,041 | 11/1975 | Wilder | 162/89 |

FOREIGN PATENT DOCUMENTS

| | | |
|---|---|---|
| 0051237 | 10/1981 | European Pat. Off. . |
| 577764 | 6/1981 | Fed. Rep. of Germany . |
| 585318 | 10/1983 | Fed. Rep. of Germany . |

OTHER PUBLICATIONS

Seike et al, Industrial and Engineering Chem. Prod. Res. Dev. 21:11–16, (1982).

Chemical Abstracts 96:202455v, (1982).

Hardt et al, in Biotechnology and Bioengineering, John Wiley & Sons, N.Y., 1982, pp. 903–918.

Kirk-Othmer Encyclopedia of Chemical Technology, 2nd Ed., vol. 22, Wiley-Interscience, 1970, pp. 383–384; 3rd Ed., vol. 4, 1978, p. 547, vol. 11, 1980, pp. 348–349, 362, 363.

The Condensed Chemical Dictionary, 6th Ed., Reinhold, N.Y., 1961, p. 590.

Concise Chemical & Technical Dictionary, Chem. Pub. Co., 1974.

Frederhugen et al, "Breakdown of Cellulose by Hydrogen Fluoride . . . ", Angewardte Chemie, Feb. 1933, vol. 46, No. 7, pp. 113–124.

*Primary Examiner*—Steve Alvo

[57] ABSTRACT

The continuous process for hydrolyzing cellulose-containing material (substrate) is carried out by sorption of gaseous HF in a sorption reaction (1) and subsequent desorption in n steps, which are carried out in n reactors which are separated from one another in a gas-tight manner. The substrate is introduced via a gas-tight valve into the sorption reactor (1), passes through this and then reaches consecutively, through gas-tight valves, a hold-up reactor (2) and the first (3*c*), second (3*b*), . . . nth desorption reactor, from which it is then removed. The desorption is carried out in each case by the action of one of the n inert gas streams on the substrate at different temperatures, the particular inert gas stream being enriched with the HF being liberated during desorption. The gas streams, which are enriched to different extents with HF, are allowed to act on the substrate in the sorption reactor (1) in such a manner that the gas streams of low HF concentration act on a substrate having a zero or low concentration of HF and thereafter the gas streams of higher HF concentration act on substrate having higher HF concentration. The total gas stream (8*a*) produced from the individual gas streams leaves, after completion of sorption, the sorption reactor (1) largely freed of HF and is either conveyed to the desorption steps after dividing up into individual gas streams or it initially passes through the last desorption step (3*a*) and is thereafter divided up and passed to the other desorption steps in order, after passing through the latter, to be returned to the sorption reactor (1).

14 Claims, 3 Drawing Figures

12a 6a
6b
6c
7a
7b
7c
1
8a
12b
2
P
4
12c
3c
5c
9c
12d
11b
9b
3b
5b
12e
11c
3a
5a
10a
9a
8a
12f

PROCESS FOR HYDROLYZING CELLULOSE-CONTAINING MATERIAL WITH GASEOUS HYDROGEN FLUORIDE

This application is a continuation of Ser. No. 434,582, filed Oct. 15, 1982 and now abandoned.

It is known that cellulose-containing material, for example wood or waste from annual plants, can be chemically digested with mineral acids. During this, the cellulose contained therein, which is a macromolecular material, is decomposed, with cleavage of glycosidic bonds, into smaller, water-soluble molecules, as far as the monomer units, the glucose molecules. The sugars thus obtained can, inter alia, be fermented to produce alcohol or used as a raw material for fermentation to produce proteins. This gives rise to the industrial importance of the hydrolysis of wood. Mineral acids which are suitable for this purpose and which were already employed on a large scale decades ago are dilute sulfuric acid (Scholler process) and concentrated hydrochloric acid (Bergius process); in this context, see, for example, Ullmanns Encyklopädie der technischen Chemie (Ullmann's Encyclopedia of Industrial Chemistry), 3rd edition, Munich-Berlin, 1957, volume 8, pages 591 et seq.

It is also known that hydrogen fluoride can be used for the hydrolysis of wood. Its boiling point (19.7° C.) makes it possible to bring it into contact with the substrate to be digested without water as a solvent and to recover it after digestion is complete with comparatively little expense. In this instance, suitable substrates for digestion are not only untreated material, on the contrary, it has also already been suggested that waste paper or lignocellulose, which is the residue from preliminary hydrolysis, should be used instead, and this still contains only very little hemicelluloses and other accompanying substances from wood and is composed almost exclusively of cellulose and lignin. Not only wood but also paper or residues of annual plants of all types, such as straw or bagasse, can be subjected to this preliminary hydrolysis. According to the state of the art, it comprises exposure to water or dilute mineral acid (about 0.5% strength) at 130° to 150° C. (cf. for example the handbook "Die Hefen" ("Yeasts") volume II, Nuremberg, 1962, pages 114 et seq.) or to saturated steam at 160° to 230° C. (cf. U.S. Pat. No. 4,160,695).

For the reaction of hydrogen fluoride with cellulose-containing material, three industrial process principles are known from the literature: reaction with gaseous hydrogen fluoride under atmospheric pressure, extraction with liquid hydrogen fluoride, and finally reaction with gaseous hydrogen fluoride in vacuo.

In German Pat. No. 585,318, a process and a device for treating wood with gaseous hydrogen fluoride are described in which, in a first zone of a reaction tube having a conveying screw, hydrogen fluoride gas, which can be diluted with an inert gas, is brought to reaction with wood by this zone being cooled from outside to below the boiling point of hydrogen fluoride. After digestion, which can optionally take place in an intermediate zone, according to this process the hydrogen fluoride is driven off by external heating and/or blowing out with a stream of inert gas, in order to be brought into contact again with fresh wood in the cool zone mentioned.

In practice, however, carrying out this process is difficult. When the hydrogen fluoride condenses on the substrate, it only distributes non-uniformly, so that overheating occurs in places. This is clear, for example, from German Pat. No. 606,009, in which is stated: "It has emerged that on merely moistening the polysaccharides, for example the wood, with hydrofluoric acid or on charging the wood and the like with hydrofluoric acid vapors, increases in temperature can occur which lead to partial decomposition of the conversion products formed. However, removal of this heat by cooling is difficult due to the poor thermal conductivity of the cellulose-containing material." The remedy described in this patent is extraction with liquid hydrogen fluoride, but this requires large amounts of hydrogen fluoride and is associated with the disadvantage that, in order to vaporize the hydrogen fluoride from the extract and from the extraction residue (lignin), large amounts of heat must be supplied and these must be removed again during the subsequent condensation.

Austrian Pat. No. 147,494, which was published a few years later, analyzes the two processes mentioned. The remedy described in this patent to counteract the non-uniform and incomplete degradation of the wood on digestion with highly concentrated or anhydrous hydrofluoric acid in the liquid or gaseous state at low temperatures, and to counteract the disadvantages of the high excess of hydrofluoric acid in the extraction process is an industrially elaborate process in which the wood is evacuated as far as possible before exposure to hydrogen fluoride and the recovery of the hydrogen fluoride is also carried out in vacuo. The process is also described in the journal "Holz, Roh- und Werkstoff" 1 (1938) 342–344. The high industrial cost of this process is not only due to the vacuum techniques themselves, but also due to the circumstance that the boiling point of hydrogen fluoride is already less than −20° C. at 150 mbar; this means that, without the assistance of expensive coolants or cooling units, condensation is no longer possible.

The state of the art of digesting wood with hydrogen fluoride known from the literature is characterized by the three processes or devices described. Accordingly, none of these methods or devices combines low cost and good results of digestion in a manner which is industrially satisfactory. The method of reacting, which is in itself economical, cellulose-containing material with a mixture of hydrogen fluoride and an inert gas, which originates from hydrogen fluoride desorption, according to German Pat. No. 585,318, which has already been mentioned above, is, according to the more recently published German Pat. No. 606,009, apparently adversely affected by the necessity of cooling below the boiling point of hydrogen fluoride during the absorption.

Surprisingly, it has now been found that gaseous hydrogen fluoride mixed with an inert carrier gas can be recycled almost without loss while producing a concentration on the substrate which is necessary for good yields, without it being necessary in this process to cool below the boiling point of hydrogen fluoride, which is highly disadvantageous industrially. This is possible by dividing the desorption procedure into several steps, in which the desorption of HF gas mixtures and reactant (substrate) is carried out cocurrently or countercurrently. According to the different concentration of HF on the substrate on entry into the individual desorption steps, HF gas mixtures of differing HF concentrations are formed, which act on the substrate at different points of the sorption step so that gas mixtures low in HF act on material which has zero or very low concentration of HF and gas mixtures having higher HF concentrations act on material which already has a higher concentration.

This measure was not obvious. On the contrary, statements in the literature lead to the conclusion that an adequate concentration on wood material is not possible above the boiling point of hydrogen fluoride, even when the latter is undiluted. In a report by Fredenhagen and Cadenbach, Angew. Chem. 46 (1933) 113/7, they say (page 115 bottom right-hand side to page 116 top left-hand side): "When gaseous HF is allowed to act on wood at room temperature, HF is absorbed and, as a result, the temperature rises. However, this means that no more HF is absorbed, so that the reaction comes to a standstill and no further increase in temperature occurs." Thus it was all the more surprising to find that hydrogen fluoride sorption is largely independent of the heat of reaction, which only makes itself noticeable up to relatively low concentrations, and, at a given temperature, only depends on the HF concentration in the gas mixture acting, i.e. it can also be carried out at temperatures above the boiling point of hydrogen fluoride up to the concentration levels necessary for good yields by stepwise production and use of streams having different HF concentrations.

Thus, the invention relates to a continuous process for digesting cellulose-containing material (substrate) with gaseous hydrogen fluoride by sorption of the HF and subsequent desorption, which comprises carrying out the sorption of the HF by the substrate at a temperature above its boiling point in a sorption step, and then the sorbed HF is removed from the substrate by heating in n desorption steps, wherein n is a whole number and wherein the steps mentioned are carried out in reactors which are each separated from one another in a gas-tight manner, and wherein the substrate is introduced through a gas-tight valve into the sorption reactor, passes through this and then consecutively reaches, through gas-tight valves, the first, second . . . nth desorption reactor and is removed from the last (nth) desorption reactor, and wherein the desorption is carried out in each case by action of one of n heated gas streams, countercurrently or, preferably, cocurrently with the substrate, with enrichment of the particular gas stream with the HF being liberated during desorption, and wherein the n HF gas streams, which contain an inert carrier gas in addition to HF, act on the substrate, countercurrently thereto, in such a manner that gas streams of low HF concentration act on substrate which has zero or only a low concentration of HF and gas streams of high HF concentration act on substrate which has a higher HF concentration, and wherein the total gas stream being produced from the individual gas streams leaves, after completion of sorption, the sorption reactor, being largely freed of HF, and is either conveyed, after division into individual gas streams, in the circulation to the desorption steps, or initially passes through the last desorption step and thereafter is divided up and conveyed to the other desorption steps and the sorption reactor.

n is a whole number, preferably from 2 to 6, in particular from 2 to 4.

The reactors, which are separated from one another by gas-tight valves, can be of identical or different types; examples of suitable reactors are stirred vessels, rotating cylinders, fluidized driers, moving beds, screw conveyors, vertical countercurrent or fluidized bed reactors. They can optionally be provided with a device for heating or cooling.

The cellulose-containing material which can be employed is wood or waste from annual plants (for example straw or bagasse) or, preferably, a preliminary hydrolyzate of wood or waste from annual plants, or, equally preferably, waste paper.

It is known that the presence of a certain amount of water is necessary for the digestion of celluloses, which is, of course, a hydrolytic cleavage. This water can either be introduced by being present in the substrate as residual moisture of 0.5 to 20, preferably 1 to 10, in particular 3 to 7%, by weight or by being contained in the mixture of HF and inert gas, or in both.

Transport of the reactant (substrate), the cellulose-containing material, from one reactor to another is carried out, for example, by falling free, via rotary vane valves and/or by conveying screws.

Suitable inert carrier gases are air, nitrogen, carbon dioxide or one of the inert gases, preferably air or nitrogen.

According to the invention, the gas flow is such that the gas outlet of one sorption reactor is connected, via a gas pipe having a gas pump (blower) inserted and n−1 branches, with the gas inlets of n desorption reactors, and the gas outlets of these n desorption reactors are connected, via gas pipes, with n gas inlets of the sorption reactor. A valve and a heat-exchanger are also inserted upstream of each of the gas inlets of the desorption reactors.

Heat-exchangers can also optionally be arranged upstream of the gas inlets of the sorption reactor. They each have the task, if necessary, of bringing the gas mixture intended for sorption to the optimum temperature for this purpose. Under certain circumstances, they have the additional task of condensing out any accompanying substances of the starting material which have been liberated during desorption, such as water, acetic acid or ethereal oils, but of allowing the hydrogen fluoride to pass in the form of a gas.

The gas stream leaving the sorption reactor, which contains a maximum of 5% by weight of HF and is preferably almost completely free of HF, is divided by the branches into n part-streams of gas, the size of which depends on the particular setting of the valves. These part-streams of gas are heated up in the heat-exchangers to the temperature necessary for desorption in each case and are allowed to act on the substrate in the desorption reactors, countercurrently to or, preferably, cocurrently with the substrate. During this, the n part-streams of gas are enriched again with HF by the HF given off during desorption.

This enrichment with HF is of differing extents in the individual part-streams of gas. In the first desorption reactor, during desorption of the substrate, which is introduced here having a maximum concentration of HF, a large amount of HF is liberated. In the following desorption reactors, desorption takes place on a substrate which has already had increasing amounts of HF removed in the previous desorption steps. In the last (nth) desorption reactor, only a little HF is liberated, since the substrate introduced into this has already been largely freed of HF. On leaving this last desorption reactor, the substrate only contains traces of HF.

The division into n part-streams of gas can also be carried out in such a way that the gas stream leaving the gas outlet of the sorption reactor is initially completely conveyed, after heating up in the upstream heat-exchanger, by means of the pump to the last (nth) desorption reactor, where it acts on the substrate which has already had most of HF removed. Only after leaving this last last (nth) desorption reactor is the gas stream divided up into a (nth) part-stream of gas which is conveyed directly to the corres-ponding gas inlet of the sorption reactor and into n−1 part-streams of gas which are conveyed to the penultimate ((n−1)th) to first desorption reactor, after heating up the upstream heat-exchangers in each case.

The HF concentration in the nth HF-carrier gas stream, which leaves the last (nth) desorption reactor, is relatively low and it increases continuously in the penultimate ((n−1)th) and the preceding desorption reactors and is highest in the first HF-carrier gas stream which leaves the first desorption reactor (up to above 95% by weight).

The HF-carrier gas streams of different HF concentrations are conveyed through gas pipes to the n gas inlets of the sorption reactor in such a manner that the nth HF gas stream makes contact with substrate which has only a small concentration of HF and the first HF gas stream makes contact with the substrate having an (almost) maximum concentration of HF. The other HF gas streams are conveyed to the substrate at intermediate gas inlets of the sorption reactor.

The maximum concentration of HF on the cellulose-containing material depends on its nature and characteristics and on the dwell-time in the sorption step and is accordingly between 10 and 120%, preferably between 30 and 80%, relative to the weight of the material employed.

If appropriate, the substrate having a certain concentration of HF, after leaving the sorption reactor and before entering the first desorption reactor, can also pass through a hold-up reactor, which optionally has a crushing device for coarse reactant and the temperature of which is advantageously maintained in a range between by the temperatures in the last part of the sorption reactor and in the first desorption reactor.

The optimum dwell-time, i.e. the average duration of stay of the substrate in the apparatus from the start of sorption to the end of desorption depends on the nature and characteristics of the material to be digested and must be adjusted to suit the particular case. Accordingly, it can be within the range from about 30 minutes up to about 5 hours.

The substrate temperatures selected for desorption are in the range from 40° to 120° C., preferably from 50° to 90° C., it being possible for the temperatures for the individual steps to be different, whilst the temperature selected for the relevant sorption in each case is in the range from 20° to 50° C., preferably 30° to 45° C.

In contrast to the normal countercurrent principle according to the state of the art, the arrangement according to the invention permits the rate of flow and the temperature of the HF-carrier gas mixture to be adjusted to suit the requirements depending on the concentration of HF on the substrate in the individual areas of the sorption step and the individual desorption steps, which are each different.

The invention will be illustrated in more detail by means of FIGS. 1 to 3.

Figure 1:
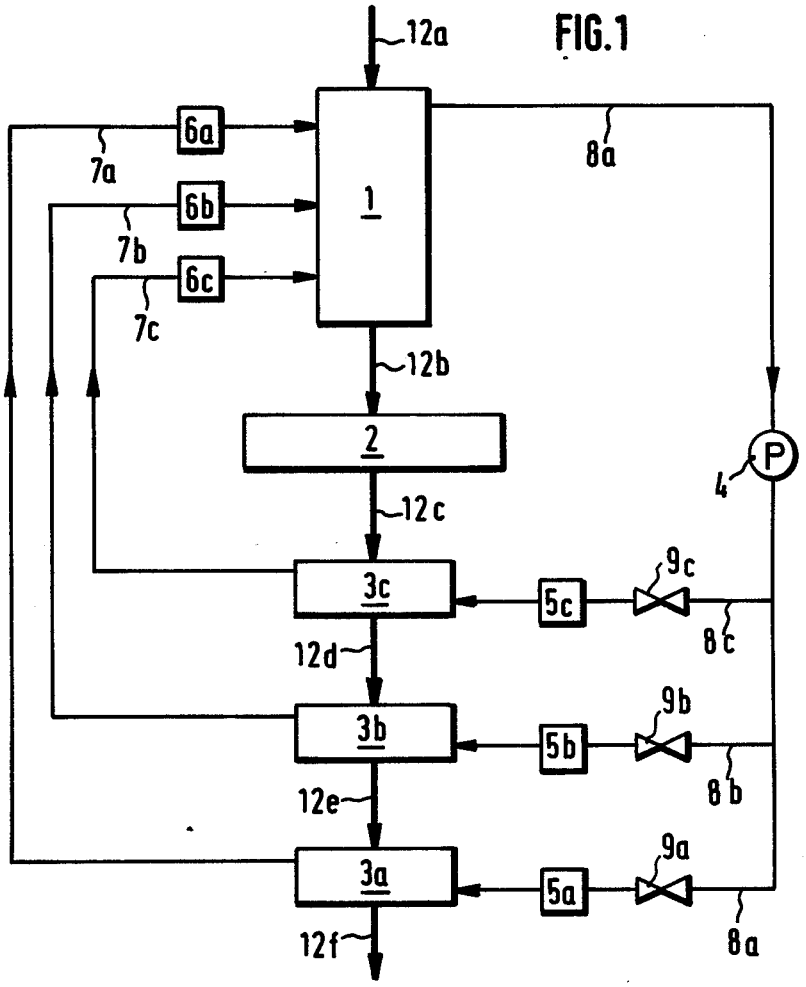
FIG. 1 shows the flow diagram of a course of reaction according to the invention in one sorption and three desorption reactors.

In these figures, the numbers represent the following:

1—sorption reactor
2—hold-up reactor
3*a, b, c*—desorption reactors
4, 4*a*—gas pumps (blowers)
5*a, b, c*—heat-exchangers
6*a, b, c*—heat-exchangers
7*a, b, c*—gas pipes from desorption reactors 3*a, b, c* to sorption reactor 1 (via heat-exchangers 6*a, b, c*)
8*a*—gas pipe from sorption reactor 1 to desorption reactor 3*a* via gas pump 4, valve 9*a* and heat-exchanger 5*a*
8*b, c*—gas pipes branching off from gas pipe 8*a* to desorption reactors 3*b, c* via valves 9*b, c* and heat-exchangers 5*b, c*
9*a, b, c*—valves (taps)
10, 10*a*—three-way valves (three-way taps)
11—gas pipe from three-way tap 10 to gas pipe 8*a*
11*c*—gas pipe from three-way valve 10*a* via valve 9*c* and heat-exchanger 5*c* to desorption reactor 3*c*
11*b*—gas pipe branching off from gas pipe 11*c* via valve 9*b* and heat-exchanger 5*b* to desorption reactor 3*b*
12*a-f*—these arrows symbolize the material flow.

The sorption reactor 1 is connected via the gas pipe 8*a*, the pump 4, the valve 9*a* and the heat-exchanger 5*a* with the desorption reactor 3*a* and this is connected via the gas pipe 7*a* and the heat-exchanger 6*a* with the sorption reactor 1. Furthermore, the sorption reactor 1 is connected via the gas pipe 8*a*, the pump 4, the gas pipes 8*b* and 8*c*, the valves 9*b* and 9*c* and the heat-exchangers 5*b* and 5*c* with the desorption reactors 3*b* and 3*c* respectively, and these are connected via the gas pipes 7*b* and 7*c* and the heat-exchangers 6*b* and 6*c* with the sorption reactor 1.

The cellulose-containing material (substrate) to be digested is introduced into sorption reactor 1. This procedure is symbolized by arrow 12*a* in FIGS. 1 and 3.

HF-inert gas mixtures, the HF concentration of which is lowest in gas pipe 7*a* and highest in gas pipe 7*c*, are conveyed via gas pipes 7*a*, 7*b* and 7*c* to the sorption reactor 1. These pass in the opposite direction to the substrate in sorption reactor 1 and leave reactor 1 as an overall gas stream which is almost completely free of HF.

The substrate having a certain concentration of HF is transported from sorption reactor 1 into hold-up reactor 2 (arrow 12*b*) and from there consecutively into the first, second and third desorption reactors 3*c*, 3*b* and 3*a* (arrows 12*c*, 12*d* and 12*e*).

The gas stream leaving sorption reactor 1 is divided up, after passing gas pipe 8*a* and pump 4, into three part streams corresponding to the particular setting of valves 9*a*, 9*b* and 9*c*. After heating in the heat-exchangers 5*a* or 5*b* or 5*c*, these part-streams of gas enter desorption reactors 3*a* or 3*b* or 3*c* respectively and are passed through this countercurrently to, or, preferably, co-currently with, the substrate.

HF is desorbed by the action of the heated gas streams on the substrate having a concentration of HF. Most HF is liberated by desorption in the first desorption reactor 3*c*, since here the substrate introduced has a maximum concentration of HF, a smaller amount is liberated in reactor 3*b* and the smallest amount of HF is liberated in the last desorption reactor 3*a*, in which the substrate entering is already almost completely freed of HF. Accordingly, the HF concentrations in the gas streams leaving the desorption reactors are highest at reactor 3*c* and lowest at reactor 3*a*. The HF gas stream leaving reactor 3*b* has an intermediate average HF concentration. The HF gas streams of different HF concentrations are fed into different inlet points of sorption reactor 1 via gas pipes 7*a* or 7*b* or 7*c*, after passing the inserted heat-exchanger 6*a* or 6*b* or 6*c* respectively. During this, the HF gas stream from gas pipe 7*a*, having the lowest HF concentration, makes contact with substrate which has only a very low concentration of HF. The HF gas stream from gas pipe 7*c* with the highest HF concentration makes contact with substrate which has (almost) the maximum HF concentration. The HF gas stream from gas pipe 7*b* is allowed to act on substrate, which already has a relatively high concentration of HF, at an intermediate point of sorption reactor 1.

After completion of desorption in reactor 3*a*, the substrate leaves this in a form which is now digested (arrow 12*f*). It only contains traces of residual hydrogen fluoride and is passed on for work-up, which is carried out in a manner known per se.

Figure 2:
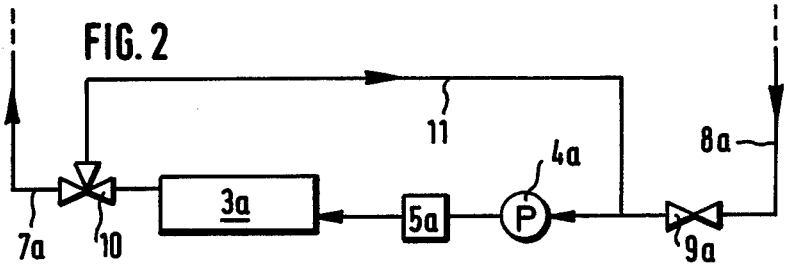
FIG. 2 shows a detail of the overall flow diagram of FIG. 1, with a further subdivision of one of the gas circulations with partial recycling.

A particular embodiment is shown schematically in FIG. 2. A three-way valve (10) is inserted in gas pipe 7*a*, which permits a (more or less large) part of the HF gas stream leaving desorption reactor 3*a* to be returned again via a gas pipe (11) in a special circulation and to be introduced, between valve 9*a* and an inserted pump (4*a*), into gas pipe 8*a* via a branch. The three-way valve 10 can also be a control valve. The part of the HF-inert gas mixture returned in this special circulation is about 10 to about 90%, preferably about 50 to about 90%, of the total mixture leaving desorption reactor 3*a*. Obviously, the three-way valve 10 can also be replaced by a T piece and a (control) valve can be incorporated into gas pipe 11.

This particular arrangement, which also makes possible a partial return of the HF-inert gas mixtures leaving desorption reactors 3*c* and 3*b* in analogy, permits optimization of the gas flow rates of the HF-inert gas mixtures passing through.

Figure 3:
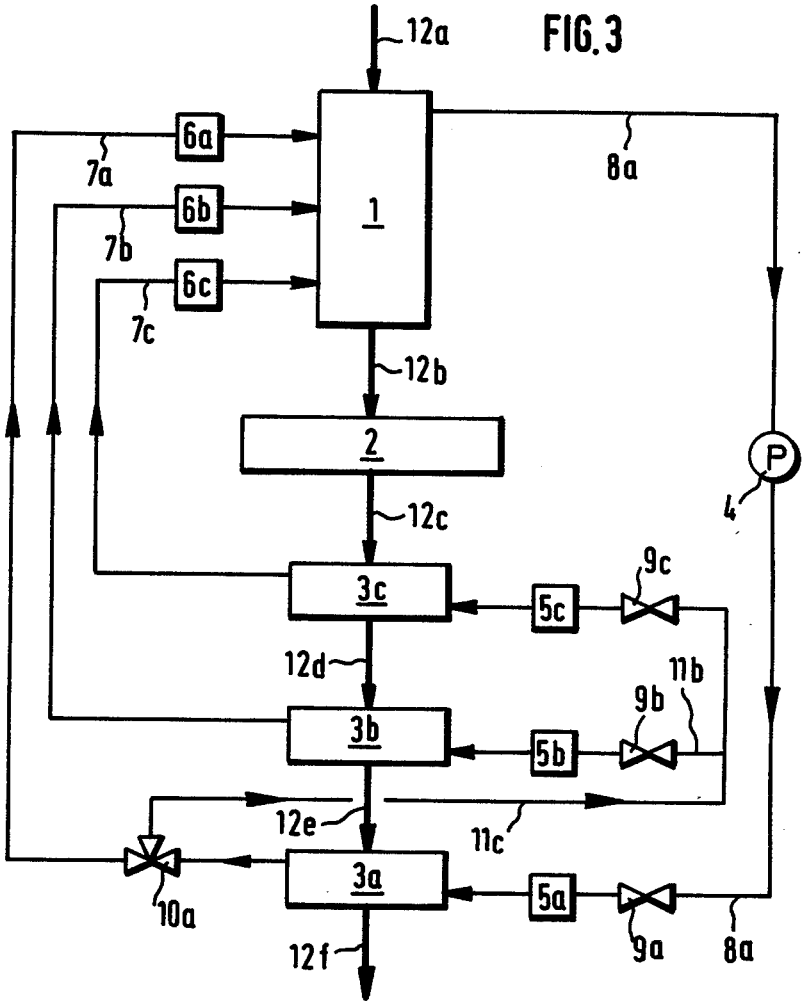
FIG. 3 shows the flow diagram of a further possible reaction course according to the invention in one sorption and three desorption reactors.

FIG. 3 shows another special embodiment of the process according to the invention. A three-way valve (10*a*) is inserted in gas pipe 7*a* which permits the gas stream leaving sorption reactor 1 to be divided into part-streams of gas only after passing through desorption reactor 3*a*. While one part-stream only passes through reactor 3*a* and is conveyed directly to sorption reactor 1, the two other part streams are also passed through a second desorption reactor (3*c* or 3*b*), before they are conveyed to reactor 1 through gas pipes 7*c* or 7*b*.

This particular embodiment permits the action on the substrate of as large an amount of gas as possible in the last desorption step, that is to say the total amount of carrier gas, the desorption being accelerated by this means.

It is advantageous to utilize for sorption any HF still contained in the gas stream leaving the sorption reactor by passing this gas stream through the substrate storage silo before it is conveyed to pump 4 via gas pipe 8*a*.

The material prepared by digestion in the process according to the invention is a mixture of lignin and oligomeric saccharides. It can be worked up in a manner known per se by extraction with water, advantageously at an elevated temperature or at the boiling point, with simultaneous or subsequent neutralization with lime. Filtration provides lignin which, for example, can be used as a fuel, as well as a small amount of calcium fluoride which originates from the residual hydrogen fluoride present in the material from the reaction. The filtrate, which is a clear pale yellowish saccharide solution, can either be conveyed directly, or after adjustment to an advantageous concentration, for alcoholic fermentation or enzyme action. The dissolved oligomeric saccharides can also be converted almost quantitatively to glucose by a brief after treatment, for example with very dilute mineral acid at temperatures above 100° C.

EXAMPLE 1

Example 1 was carried out in equipment arranged as is shown schematically in FIG. 1. It comprised a sorption reactor (1), a hold-up reactor (2) and three desorption reactors (3*a*, 3*b* and 3*c*), which were connected with one another by pipelines and rotary vane valves. A vertically positioned tube composed of stainless steel of 5 cm internal diameter and 80 cm length, which had on its upper end a gas-tight rotary vane valve with a hopper and also had a gas-tight rotary vane valve on the lower end, served as the sorption reactor. A slowly rotating shaft provided with narrow blades was arranged in the longitudinal axis of the tube. Inlets for HF-containing gases were situated at 3 points which were distributed over the lower two-thirds of the length of the tube. The gas outlet was positioned a short distance below the upper rotary vane valve. The hold-up reactor was a cylindrical vessel of approximate volume 2 liters composed of semi-transparent polyethylene. The desorption reactors were composed of stainless steel and were formed as heatable rotating cylinder reactors which could be passed through by the substrate and by the gases flowing in the same direction. The utilizable volume of the desorption reactors was about 3 liters each.

Granulated lignocellulose, which had been obtained as the residue from a preliminary hydrolysis of sprucewood shavings and which had a water content of about 3% by weight, was conveyed continuously by its own weight from above to below in the sorption reactor (1). HF-nitrogen mixtures of different concentrations originating from desorption were introduced through the three gas pipes, with the highest HF concentration at the lowest inlet point and with the lowest HF concentration at the highest inlet point. The transport rate was controlled with the aid of samples taken from the lower rotary vane so that the reaction mixture leaving the reactor contained about 60 g of HF per 100 g of lignocellulose employed. The substrate fell freely from the lower rotary vane valve into the hold-up reactor (2) and remained there for an average of 30 minutes. A temperature of 50° C. was maintained inside the vessel by blowing on warm air. The nitrogen, which was almost free of HF, leaving the top of the sorption reactor (1) was divided over the three desorption reactors (3*a*, 3*b* and 3*c*) by a gas line (8*a*) via a gas pump (4) and the gas pipes (8*b*, 8*c*) branching off. The nitrogen introduced into each desorption reactor was regulated by means of the throttle valves (9*a*, 9*b* and 9*c*) and the gas heaters (5*a*, 5*b* and 5*c*) so that, with the aid of the heating present on the reactor itself, the following gas mixtures and degrees of desorption were obtained:

First desorption reactor (3c): Lignocellulose having an HF concentration in the weight ratio 60:100 was introduced from the hold-up reactor (2) by means of a gas-tight rotary vane valve; a substrate having a concentration of about 35:100 (weight ratio of HF to lignocellulose) was removed; the desorption temperature was 60°-70° C.; the gas mixture emerging contained about 65% by weight of HF.

Second desorption reactor (3b): The product containing HF from the first desorption reactor (3c) was introduced by means of a gas-tight rotary vane valve; a substrate having a concentration of about 10:100 was removed; the desorption temperature was 70°-80° C.; the gas mixture emerging contained about 25% by weight of HF. Third desorption reactor (3a): The product containing HF from the second desorption reactor (3b) was introduced by means of a gas-tight rotary vane valve; a substrate having about 0.5% by weight of HF was removed; the desorption temperature was about 90° C.; the gas mixture emerging contained about 5% by weight of HF.

The three gas mixtures produced in the desorption reactors were passed into the sorption reactor (1) in the manner already described above through the pipelines (7a, 7b and 7c) and the heat-exchangers (6a, 6b and 6c), where they were cooled down to 25°-30° C., so that circulations of carrier gas (nitrogen) and HF were set up while the substrate was continuously conveyed through the equipment.

The digested substrate, which was largely free of HF, was extracted in a customary manner with hot water, and the solution thus obtained was neutralized with calcium hydroxide, filtered and evaporated. Wood sugar, having a pale color, was thus obtained in a yield of 90% relative to the cellulose originally present.

EXAMPLE 2

Untreated spruce-wood shavings, which had been dried to a residual moisture of about 5% by weight, were digested in the equipment described in Example 1 and in accordance with the process described in detail there. During desorption in reactors 3c to 3a, materials associated with wood, such as acetic acid, were also driven out and condensed out in heat-exchangers 6c to 6a and separated off. After a customary work-up, as described in Example 1, wood sugar was obtained in a yield of about 70% by weight, relative to the carbohydrates contained in the material employed.

We claim:

1. A continuous process for hydrolyzing cellulose-containing material to obtain hydrolytic cleavage of cellulose macromolecules and formation of smaller, water-soluble molecules, in which sorption of gaseous hydrogen flouride occurs followed by desorption of the HF, said process comprising:

carrying out the sorption of the HF by the cellulose-containing material at a temperature above the boiling point of HF in a sorption step, and then removing the sorbed HF by the action of heated gas streams in n desorption steps, wherein n is a whole number and wherein the sorption and desorption steps are carried out in zones separated from each other in a gas-tight manner; the cellulose-containing material being passed through a gas-tight valve into the sorption zone and then passed therethrough such that said cellulose-containing material acquires an increasing level of HF sorption in said sorption zone;

passing said material containing sorbed HF, through gas-tight valves, consecutively through the first through the nth desorption zones;

the desorption in each desorption zone being carried out by the said action of one of n heated gas streams, each said gas stream comprising an inert carrier gas which becomes enriched with HF gas due to the HF liberated during desorption, resulting in n HF-enriched gas streams varying in HF concentration;

passing the HF-enriched gas stream of lowest HF concentration to the sorption zone to act on cellulose-containing material having the lowest concentration of sorbed HF and passing the HF-enriched gas stream of highest concentration to the sorption zone to act on the material having the highest concentration of sorbed HF;

conveying from the sorption zone a total gas stream obtained from the individual gas streams in the sorption zone, after completion of sorption, said total gas stream being substantially depleted of HF, such that said total gas stream, or subdivided portions thereof, can be circulated through said desorption zones; and removing thus hydrolyzed and thus desorbed material from the nth desorption zone.

2. A process according to claim 1, wherein said total gas stream initially passes through the nth desorption zone and thereafter is divided up and conveyed to the other desorption zones.

3. A process according to claim 1, wherein said total gas stream is divided into n heated gas streams which are conveyed to the n desorption zones.

4. A process according to claim 1, wherein the desorption is carried out in each desorption zone by the action of one of n heated gas streams concurrently with said material.

5. A process according to claim 1, wherein n is a whole number from 2 to 6.

6. A process according to claim 5, wherein n is 2 to 4.

7. A process according to claim 5, wherein said cellulose-containing material comprises a preliminary hydrolyzate of wood or wood waste from annual plants or waste paper.

8. A process according to claim 5, wherein said inert carrier gas is air or nitrogen.

9. A process according to claim 5, wherein said HF-enriched gas stream is divided up after leaving a desorption zone and one part is directly returned to the inlet of said desorption zone.

10. A process according to claim 5, wherein several HF-enriched gas streams are divided up after leaving the desorption zones and one part of each of said HF-enriched gas stream is directly returned to the inlet of the respective desorption zone.

11. A process according to claim 1, wherein said cellulose-containing material comprises a preliminary hydrolyzate of wood or waste from annual plants or waste paper.

12. A process according to claim 1, wherein said inert carrier gas is air or nitrogen.

13. A process according to claim 1, wherein said HF-enriched gas stream is divided up after leaving a desorption zone and one part is directly returned to the inlet of said desorption zone.

14. A process according to claim 1, wherein several HF-enriched gas streams are divided up after leaving the desorption zones and one part of each said HF-enriched gas stream is directly returned to the inlet of the respective desorption zone.

* * * * *